US012487060B1

(12) United States Patent
Nykoluk

(10) Patent No.: US 12,487,060 B1
(45) Date of Patent: Dec. 2, 2025

(54) COVER FOR TACTICAL ARMOR SYSTEM

(71) Applicant: First Tactical, LLC, Modesto, CA (US)

(72) Inventor: Cory Nykoluk, Oakdale, CA (US)

(73) Assignee: First Tactical, LLC, Modesto, CA (US)

( * ) Notice: Subject to any disclaimer, the term of this patent is extended or adjusted under 35 U.S.C. 154(b) by 0 days.

(21) Appl. No.: 18/819,932

(22) Filed: Aug. 29, 2024

Related U.S. Application Data

(60) Provisional application No. 63/580,292, filed on Sep. 1, 2023.

(51) Int. Cl.
*F41H 5/013* (2006.01)
*F41H 1/02* (2006.01)

(52) U.S. Cl.
CPC ..... *F41H 1/02* (2013.01)

(58) Field of Classification Search
CPC ..... F41H 1/02
See application file for complete search history.

(56) References Cited

U.S. PATENT DOCUMENTS 4,266,297 A * 5/1981 Atkins ..... F41H 1/02 2/2.5
4,485,491 A * 12/1984 Rasmussen ..... F41H 1/02 2/2.5
5,157,792 A * 10/1992 Allen ..... F41H 1/02 2/92
5,331,683 A * 7/1994 Stone ..... F41H 1/02 2/92
5,526,862 A * 6/1996 Ghilardi ..... B60C 17/0027 152/549
6,066,017 A * 5/2000 Max ..... B63C 9/115 521/917
6,526,862 B1 * 3/2003 Lyons ..... F41H 5/0485 2/2.5
7,636,948 B1 * 12/2009 Crye ..... A41D 31/12 2/2.5
8,776,262 B2 * 7/2014 Blauer ..... F41H 1/02 2/92
9,820,514 B2 * 11/2017 Nykoluk ..... A41D 13/0007
9,894,962 B2 * 2/2018 Strum ..... A44B 11/006
9,993,039 B2 * 6/2018 Nykoluk ..... A41D 13/0562
10,485,272 B2 * 11/2019 Blauer ..... A41D 27/02
10,871,351 B2 * 12/2020 Becker ..... F41H 1/02
12,044,508 B2 * 7/2024 Thompson ..... A41D 1/04
12,082,631 B2 * 9/2024 Johnson ..... A41D 1/04
(Continued)

*Primary Examiner* — Robert H Muromoto, Jr.
(74) *Attorney, Agent, or Firm* — Geoffrey Lottenberg; Berger Singerman LLP

(57) ABSTRACT

A cover for soft armor has a mantle extending from front waist to rear waist, with a head/neck opening and formed of an outer fabric layer and an inner liner secured to the outer fabric layer at particular locations. An additional liner is positioned between the outer fabric layer and the inner liner and secured to the inner liner to produce a sling along with the inner liner, positioned to receive and support portions of the soft armor at front and back of the mantle. The sling is openable and closable at a bottom of the sling for insertion of soft armor portions. At front and back the inner liner is split along a vertical center line providing for opening left and right portions upwardly and outwardly, for convenient loading of the armor.

5 Claims, 10 Drawing Sheets

(56) References Cited

U.S. PATENT DOCUMENTS

| | | | | |
|---|---|---|---|---|
| 12,117,274 | B2 * | 10/2024 | Blauer | F41H 5/013 |
| 2001/0050492 | A1 * | 12/2001 | Janevski | B60R 21/12 2/97 |
| 2006/0037121 | A1 * | 2/2006 | Park | F41H 5/0485 2/2.5 |
| 2008/0263737 | A1 * | 10/2008 | Parks | F41H 1/02 2/2.5 |
| 2014/0150161 | A1 * | 6/2014 | Nykoluk | A41D 13/0007 428/221 |
| 2016/0044976 | A1 * | 2/2016 | Nykoluk | A41D 13/0568 2/2.5 |
| 2017/0303607 | A1 * | 10/2017 | Iser | A41D 27/20 |
| 2018/0042314 | A1 * | 2/2018 | Morisch Hurst | A41D 27/16 |
| 2020/0359709 | A1 * | 11/2020 | Cleghorn | A41D 31/125 |

* cited by examiner

COVER FOR TACTICAL ARMOR SYSTEM

This application claims benefit of provisional application Ser. No. 63/580,292, filed Sep. 1, 2023.

BACKGROUND OF THE INVENTION

The invention concerns tactical gear, in particular covers for soft armor, the armor including a carrier over the armor.

A significant number of different covers have been described for soft armor, with the intention of producing an exterior look appearing like a normal uniform of police or military personnel. Some such covers have included false vest pockets and placket, even inoperable buttons or other fasteners at the exterior of the cover. Typically an officer will wear such a cover over a standard uniform shirt of essentially the same color, so that the armor cover appears as part of the shirt or overshirt.

Examples are U.S. Pat. Nos. 5,157,792, 5,331,683, 6,526,862, 8,528,112, 8,776,262, 10,139,199, Pub No. 2016/0116255.

In the prior art many different arrangements for containing and for inserting and removing armor carriers (which contain the body armor) to and from the cover have been described. In a typical such cover, hook and loop fasteners and/or zippers are used to provide access to insert the carrier-containing armor into the cover garment, typically from a bottom side of the cover's mantle. Thus, the weight of the body armor is carried primarily on the shoulders of the user, via the mantle which extends from front waist to rear waist of the wearer.

While some of the cover vests of the prior art have been effective and have generally made the overall appearance of the vest and official shirt look harmonious or possibly integrated, many of these have involved an outer fabric layer, i.e. the layer visible from outside, as a layer which carries the armor. Pursuant to the invention it has been found preferable to avoid this arrangement. In addition, many such armor covers have been uncomfortable, particularly in very warm environments or even very cold environments, and have been less than optimal in convenience for inserting and removing the armor. These concerns are addressed by the current invention as described below. In this description the armor/carrier assembly is often referred to as "the armor", or "the soft armor".

SUMMARY OF THE INVENTION

According to the invention a cover for a ballistic vest carrier has a mantle extending from front waist to rear waist, with a head/neck opening and formed of an outer fabric layer and an inner liner secured to the outer fabric layer at particular locations. An additional liner is positioned between the outer fabric layer and the inner liner and is secured to the inner liner to produce a sling along with the inner liner, to receive and cover portions of the armor at front and back of the mantle.

The outer fabric layer is detached from and free of the inner liner at bottom edges of the front and back of the mantle. The sling is openable and closable at a bottom of the sling for insertion of the separate ballistic vest carrier portions. At front and back the inner liner is split along a vertical center line providing for opening left and right portions of the liner upwardly and outwardly, for convenient loading of the armor into the sling.

In a preferred embodiment the head/neck opening has a soft, cushioned collar at rear for increased comfort, particularly for the load borne on the shoulders. Further, pockets for thermal packs (cold or warm) are provided in the mantle, preferably at front and back, left and right.

These and other objects, advantages and features of the invention will be apparent from the following description of a preferred embodiment, considered along with the accompanying drawings.

DESCRIPTION OF PREFERRED EMBODIMENTS

Figure 2:
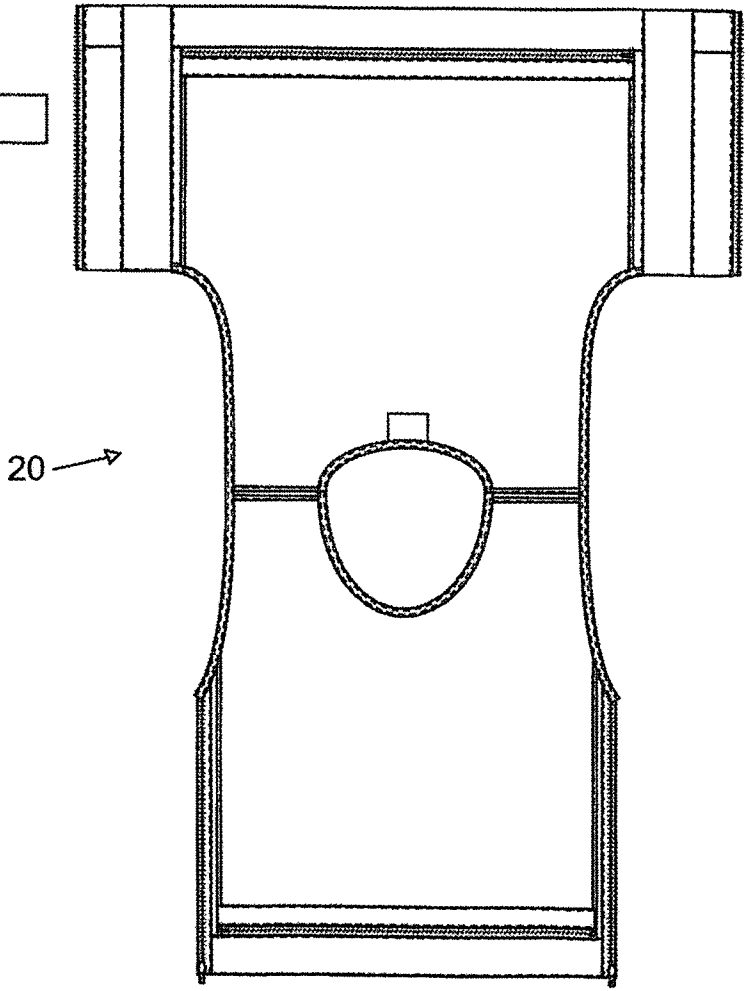
FIG. 2 PRIOR ART
FIG. 2 shows a typical armor cover, as prior art.
Figure 1:
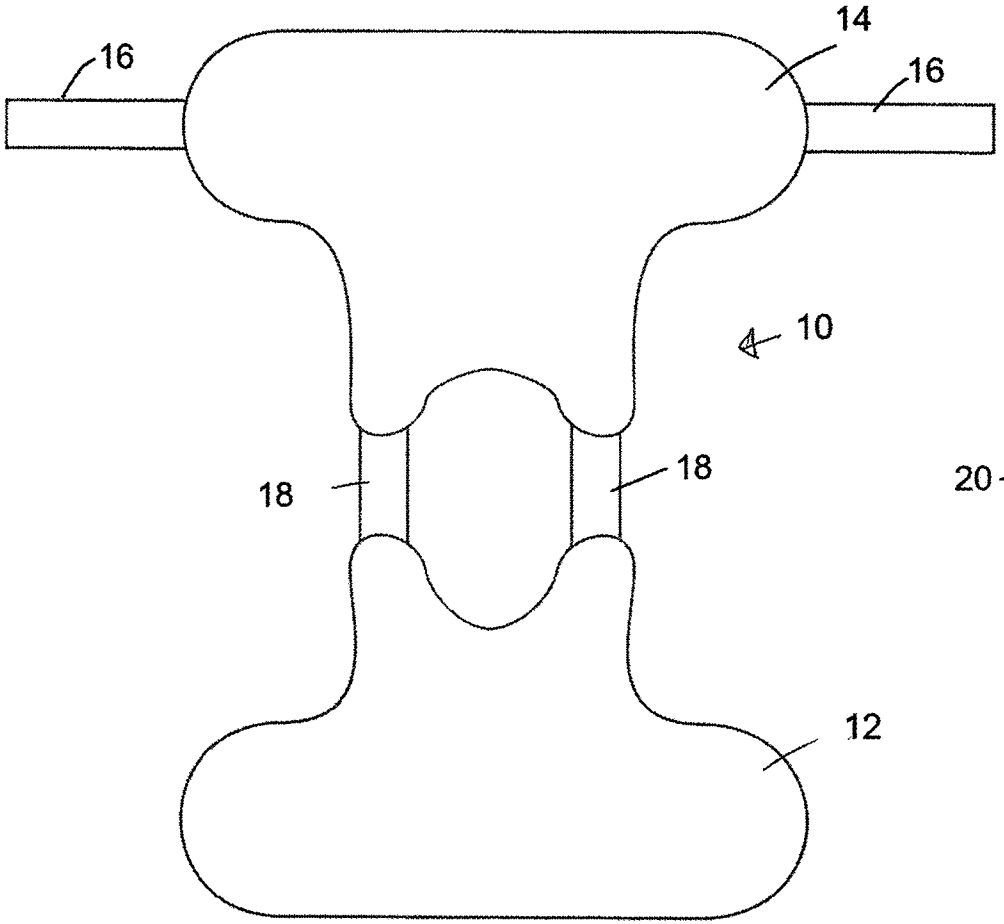
FIG. 1 PRIOR ART
FIG. 1 is a plan view showing soft armor (ballistic and/or spike armor) covered by a carrier that envelops the armor, constituting prior art.
Figure 3:
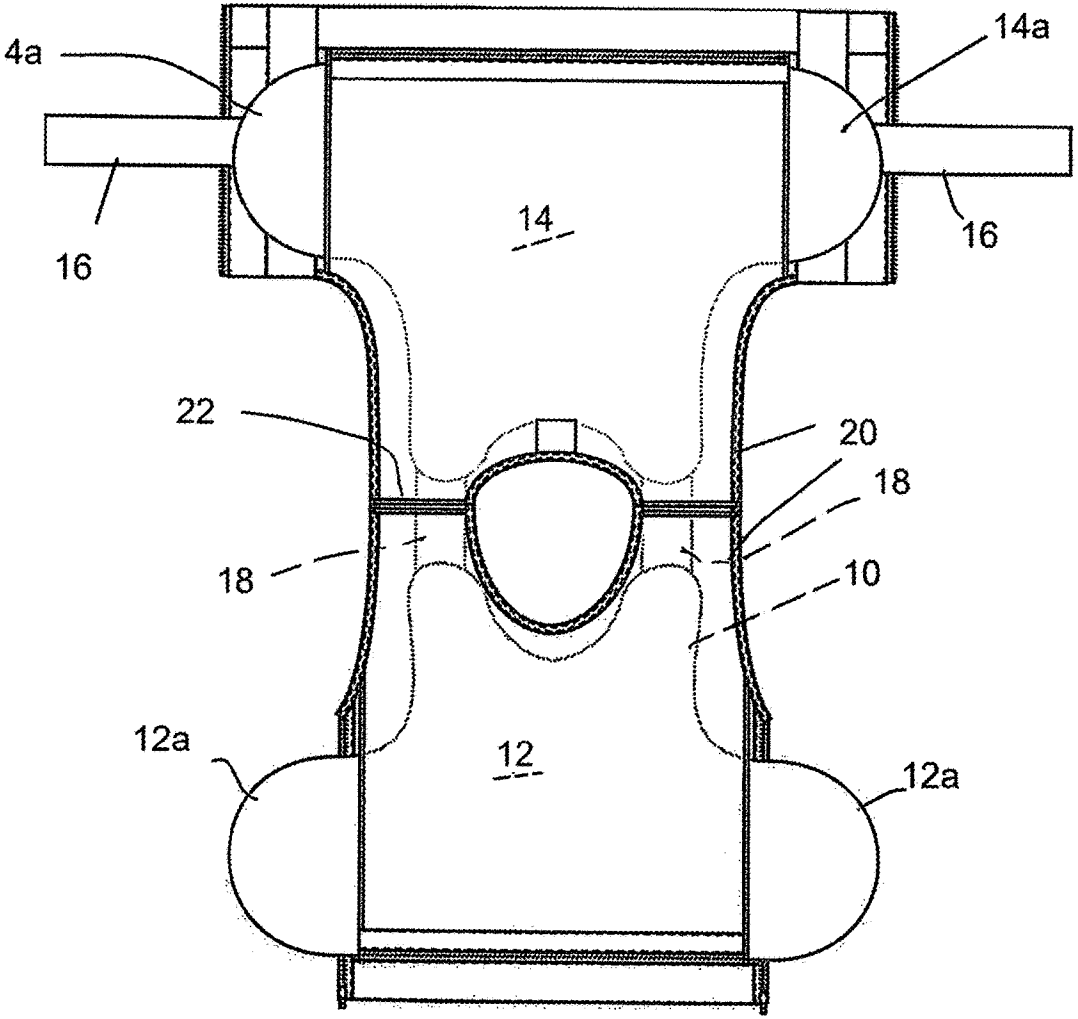
FIG. 3 PRIOR ART
FIG. 3 shows the soft armor within a typical cover, as prior art.

FIGS. 1, 2 and 3 show soft armor, as in the prior art, and a typical cover (FIGS. 2 and 3). In FIG. 1 the soft armor 10 is depicted in flattened configuration, and including a carrier over the armor. The armor has a front portion 12, a back portion 14, side straps 16 extending from the back, and shoulder straps 18. A cover to receive the armor is shown at 20 in FIG. 2.

As shown in the schematic of FIG. 3, the soft armor fits into the cover 20 such that wings 12*a* and 14*a* of the armor at front and back extend out through side slots 22 of the cover. The drawing also indicates the shoulder straps 18 of the armor (provided with the carrier enveloping the armor elements), connected after the front and back armor portions 12 and 14 have been inserted into the cover. Access slots of the cover are available for this purpose, generally indicated at 24.

Figure 4:
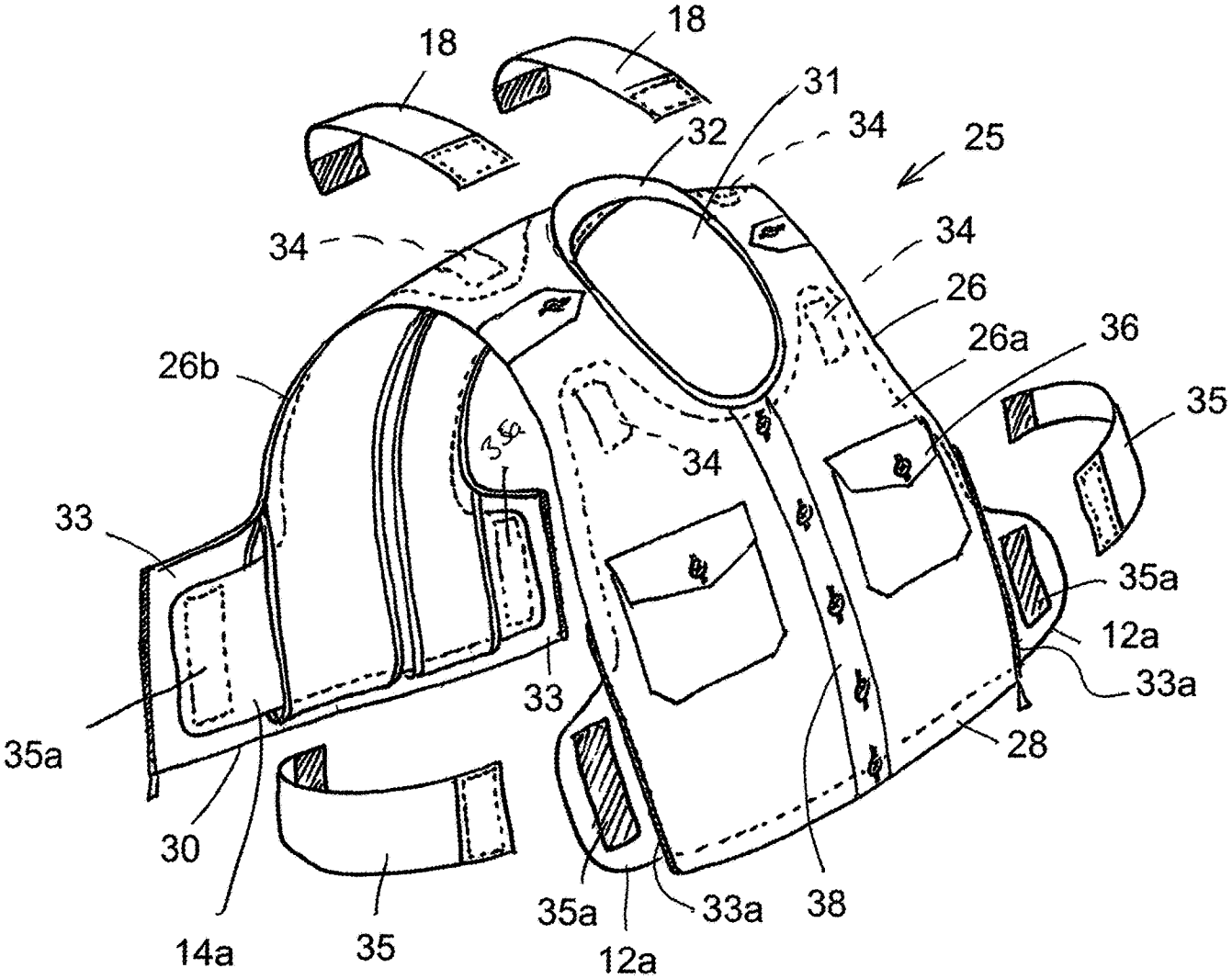
FIG. 4 is a perspective view showing a cover of the invention, for covering soft armor such as in FIGS. 1-3.

FIG. 4 shows in perspective, somewhat schematic, a cover 25 according to the invention which receives the soft armor. Shown in FIG. 4 is a mantle 26, including front mantle section 26*a* and a rear mantle section 26*b*, extending continuously from front waist 28 to rear waist 30. A head/neck opening is indicated at 31, and in accordance with a preferred embodiment of the invention, a cushioned, preferably wicking collar 32 is provided for comfort of the wearer. FIG. 4 indicates the shoulder straps 18 which are shown separate from the mantle, but which are inserted via inner slits (not seen in FIG. 4 but seen in FIG. 3 at 24) to connect with hook and loop fastener connections 34 at the four indicated locations within the mantle. Also shown are bands 35 at left and right, with hook/loop fastener patches on ends, for mating with patches 35*a* on the outer wings 12*a* and 14*a* of the armor. These bands and patches are provided by the soft armor manufacturer and are secured to the armor wings after the carrier with the armor has been inserted into the cover 25.

FIG. 4 also shows that the mantle preferably has the appearance of the front of an officer's shirt, with functional or false pockets 36 and a false placket 38. When the mantle is worn, this is over the officer's long sleeve shirt, and with color coordinated, the appearance of the officer wearing the soft armor is that of an integrated shirt.

Figure 4A:
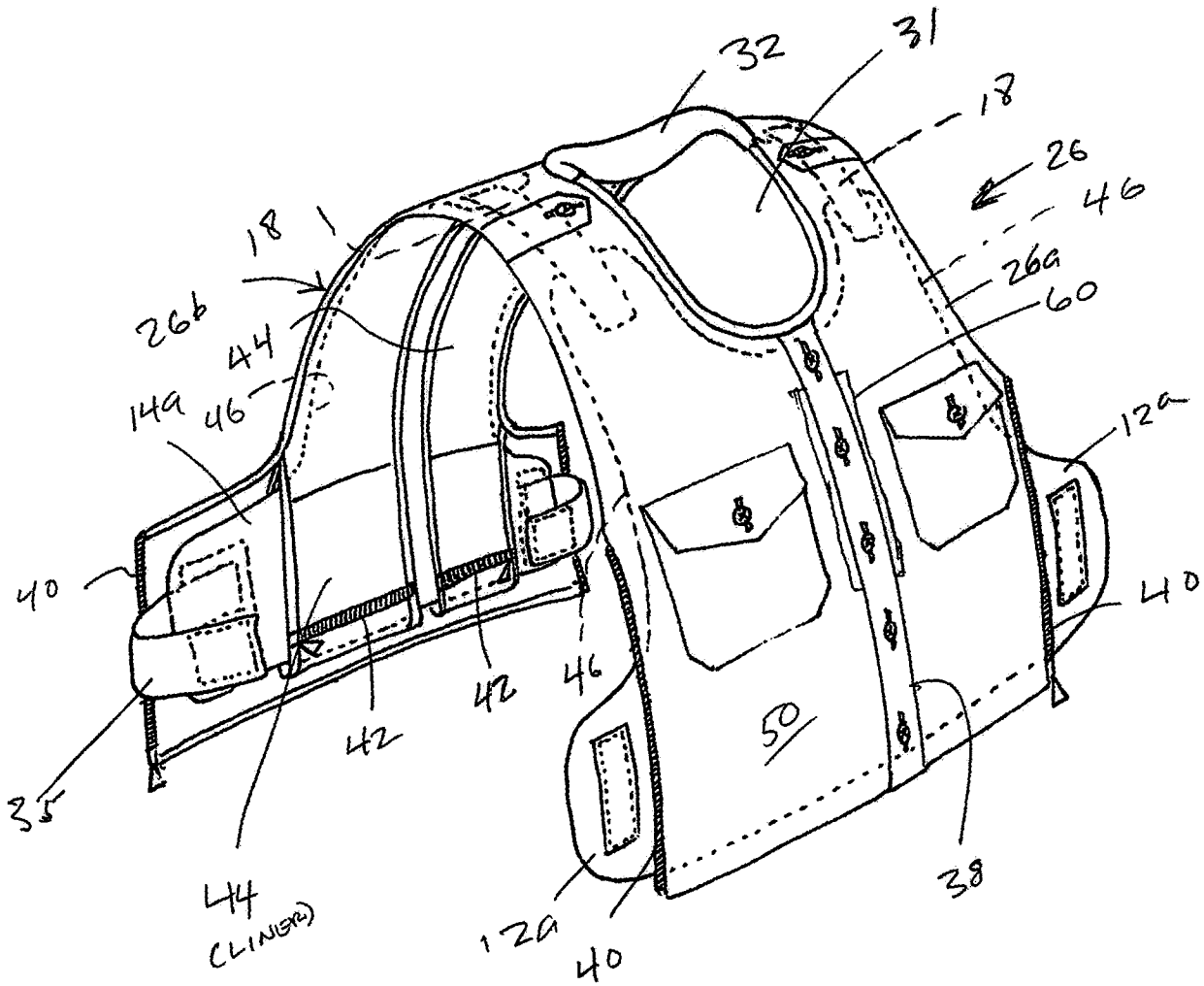
FIG. 4A is a view similar to FIG. 4 and showing additional features.

FIG. 4A is similar to FIG. 4 but showing further details. The side straps 35 are shown secured to the rear wings 14*a*, ready to be secured to the mating hook/loop fastener patches on the front wings 12*a* when the cover is donned. Also, the shoulder straps 18 have been installed, shown in dashed lines. Zippers 40 are secured together after the wings 12*a*, 14*a* have been secured. This will complete the assembly of the cover.

FIG. 4A also shows zippers at 42, one on each side of an inner liner 44 of the cover. The inner liner 44 is split into two halves, left and right as seen in the rear portion 26*b* of the mantle. The same is true of the liner in the front portion 26*a*, although that is not seen directly in FIG. 4A. In dashed lines 46 are shown the outlines of the soft armor within the cover.

FIG. 4A also shows a preferred feature of the cover wherein document pockets 60 are included, open or openable at front adjacent to the false placket 38, preferably at both sides. This is further explained below with reference to FIG. 6A.

Figure 5:
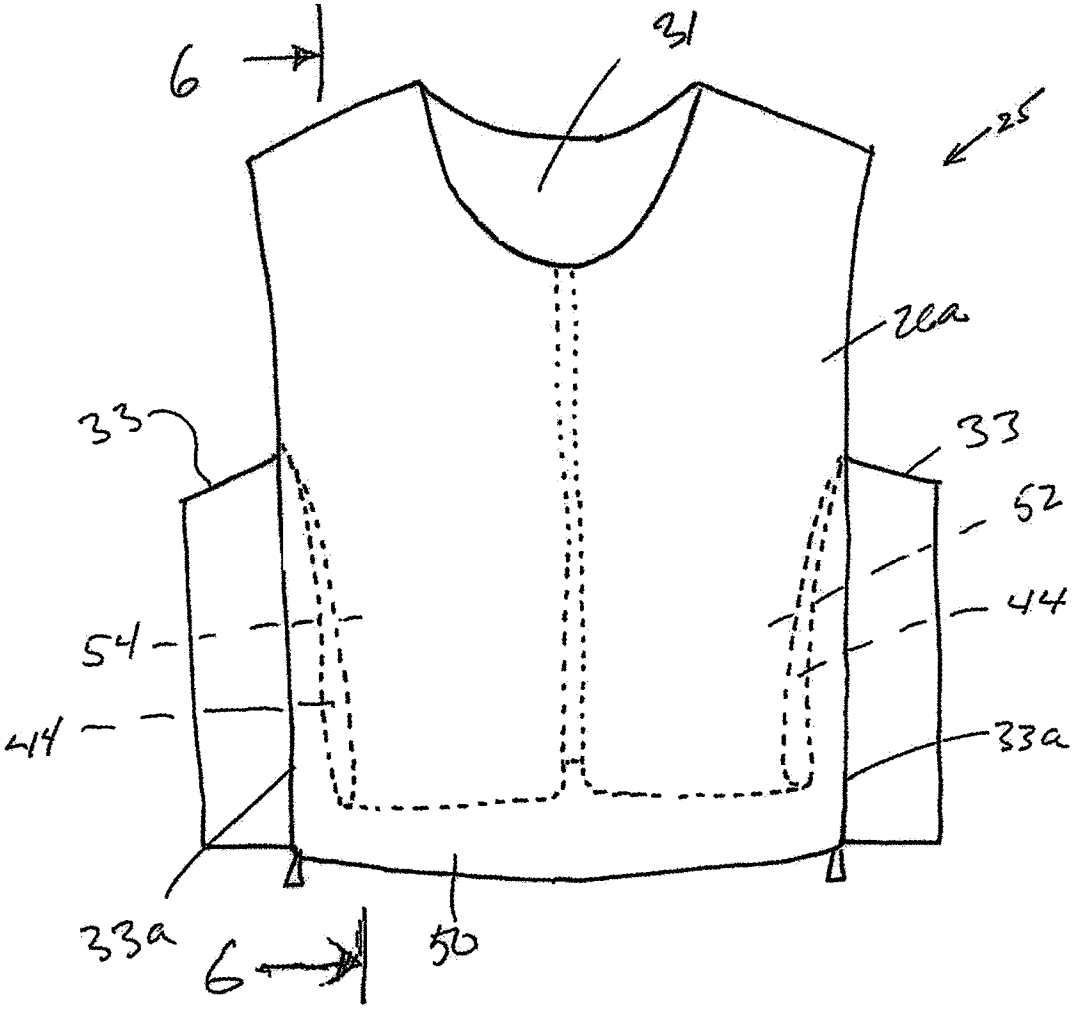
FIG. 5 schematically indicates the armor cover of the invention, showing a front side.

FIG. 5 shows a front view of the mantle, primarily the front portion 26*a*, which is formed of an outer fabric layer 50, and an inner sling 52 that is in part comprised of the inner liner 44, in combination with an intermediate layer 54. The sling supports the soft armor assembly such as shown in FIG. 3. As shown in FIG. 5, the back side 26*b* of the mantle includes the outwardly extending tabs or wings 33 that enable securing the cover to itself around the sides of the wearer. These tabs are secured to the front cover edges 33*a* by zippers or other securement such as hook and loop fasteners.

Figure 6:
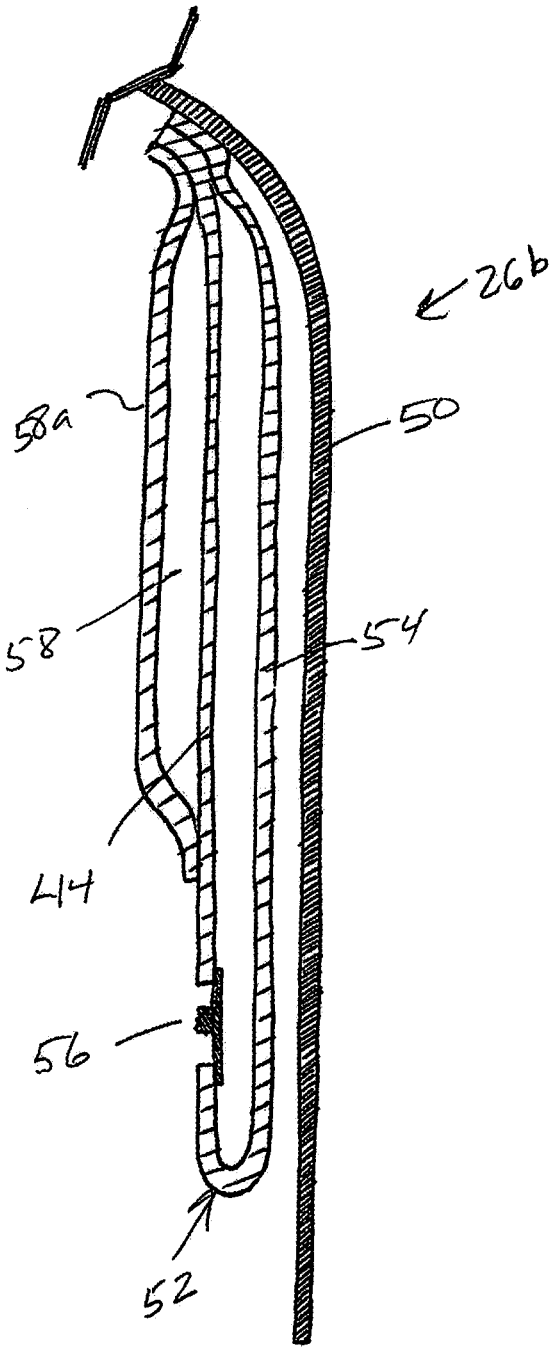
FIG. 6 is a cross sectional view showing the back portion of the armor cover.

FIG. 6 is a schematic cross sectional view showing only the back portion 26*b* of the mantle, as viewed along the plane 6-6 indicated at FIG. 5. As shown, the outer fabric layer 50 is independent of the inner sling 52, which is formed between the inner liner 44 and the additional liner or intermediate layer 54. The sling is openable near its bottom, which may be via a zipper or other type of connection such as snaps or hook/loop fasteners, a zipper being indicated at 56. When the horizontally oriented fastener 56 is opened, the soft armor can be inserted into the sling. The slits 24 for shoulder strap access are not seen in FIGS. 6 and 6A.

The inner layer preferably also supports a thermal pack pouch such as indicated at 58, formed by a further layer 58*a* attached to the inner layer 44, each pouch open or openable at left or right side for convenient insertion/removal of thermal packs. This can also be repeated at the front of the mantle. A heat pack can be inserted rather than an ice pack, when needed for comfort of the wearer.

Figure 6A:
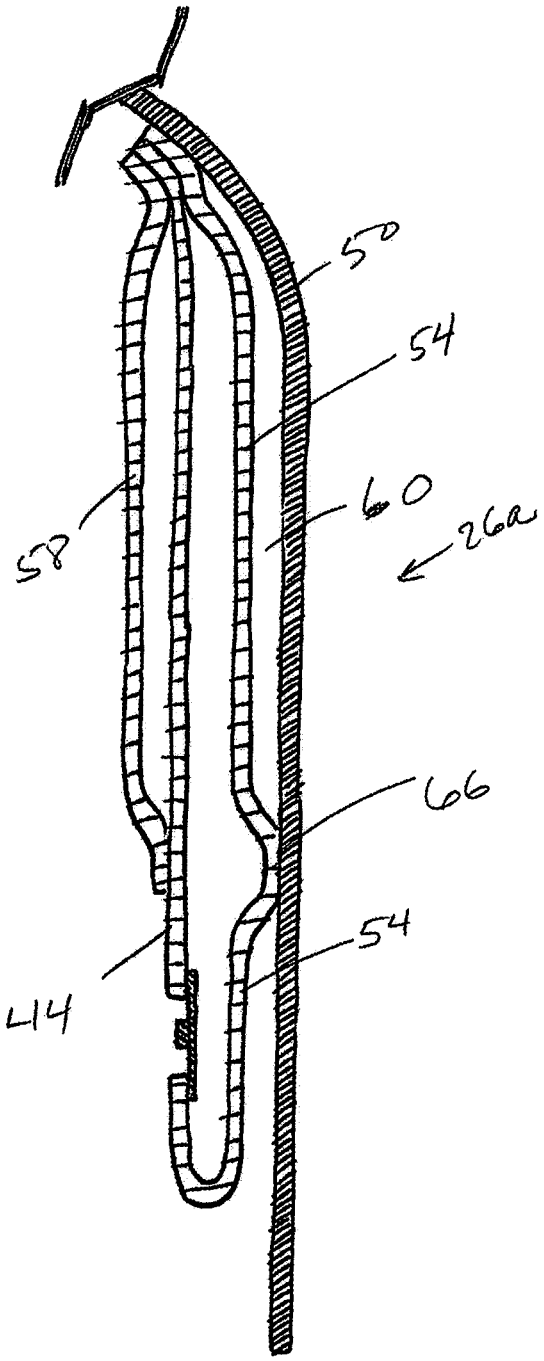
FIG. 6A is a view similar to FIG. 6, but showing the front portion of the cover, with an additional feature.

FIG. 6A shows the optional document pocket 60 (indicated in FIG. 4A) that can be contained within the front portion of the mantle. In this embodiment the intermediate layer or liner 54 is secured to the outer fabric layer at 66 (horizontal connection line) to form the document pocket 60 between the outer fabric layer 50 and an upper area of the intermediate layer 54. As shown and also illustrated in FIG. 6A, the layer 58 forming the thermal pack pocket is preferably also a part of this construction.

Figure 7:
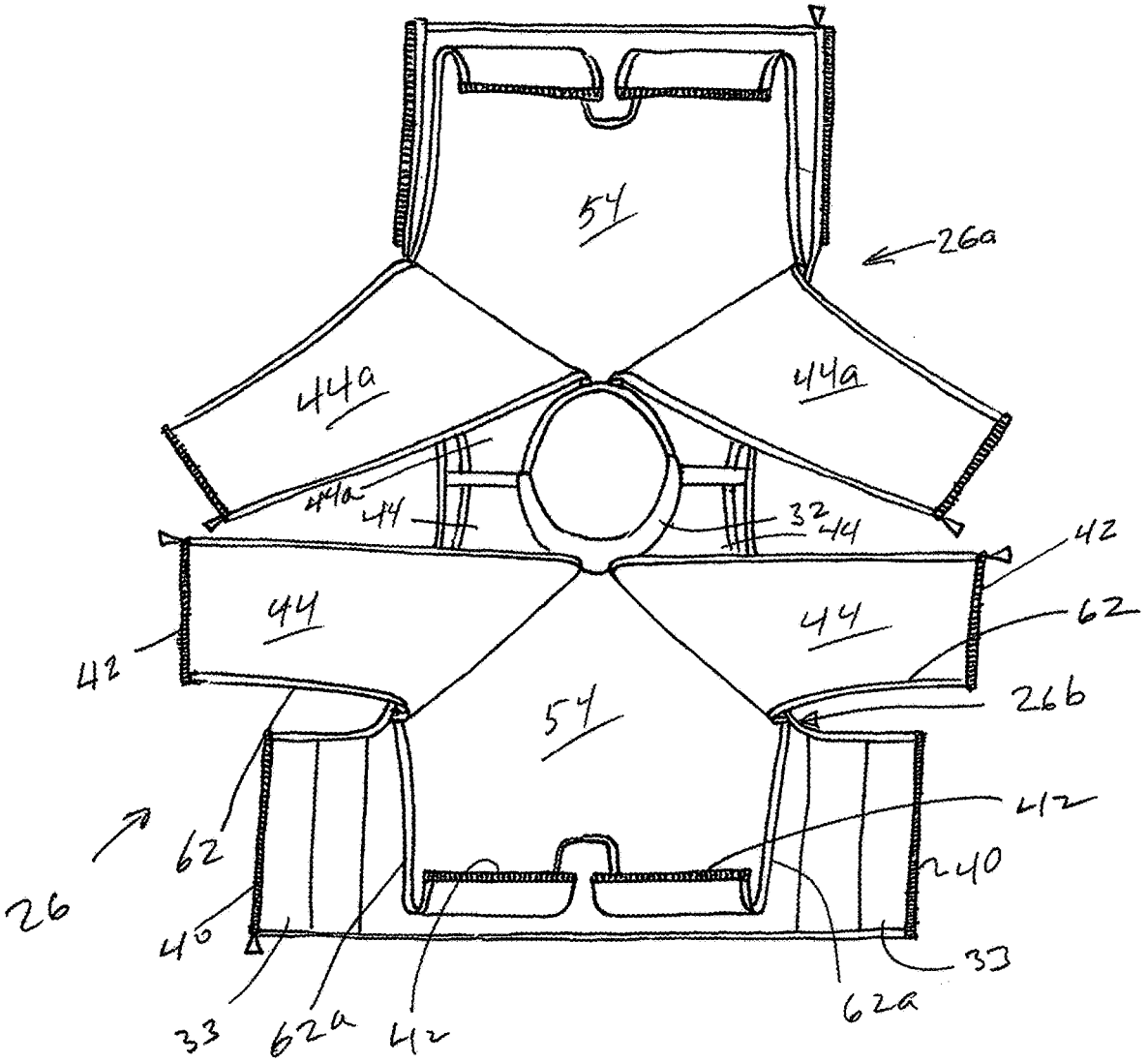
FIG. 7 is a plan view showing the flattened armor cover of the invention and illustrating access features, unzipped and pulled upwardly.

FIG. 7 is a flattened view of the cover 26, outer fabric down, showing the inner side of the mantle with an important feature of the invention. The inner liner 44, both front and back, is shown at 44 and 44*a* (back and front), in several segments. At the back 26*b* of the mantle, the inner liner 44, which is split along a vertical line as shown in FIGS. 4 and 4A, can be opened upwardly and outwardly after releasing the zippers 42, which are also in shown in FIG. 4A. Once these (or hook/loop fasteners, if used) are released, the liner sections 44 are pulled upwardly and outwardly, nearly fully opening the space provided for insertion of the carrier-contained soft armor. The side wings of the soft armor will extend out through openings formed by side edges 62 of the liner juxtaposed with side edges 62*a* of the intermediate layer 54 which, along with the inner liner 44, forms the sling. The same construction preferably is repeated at the front of the mantle, with the liner 44*a* as shown.

Figure 8:
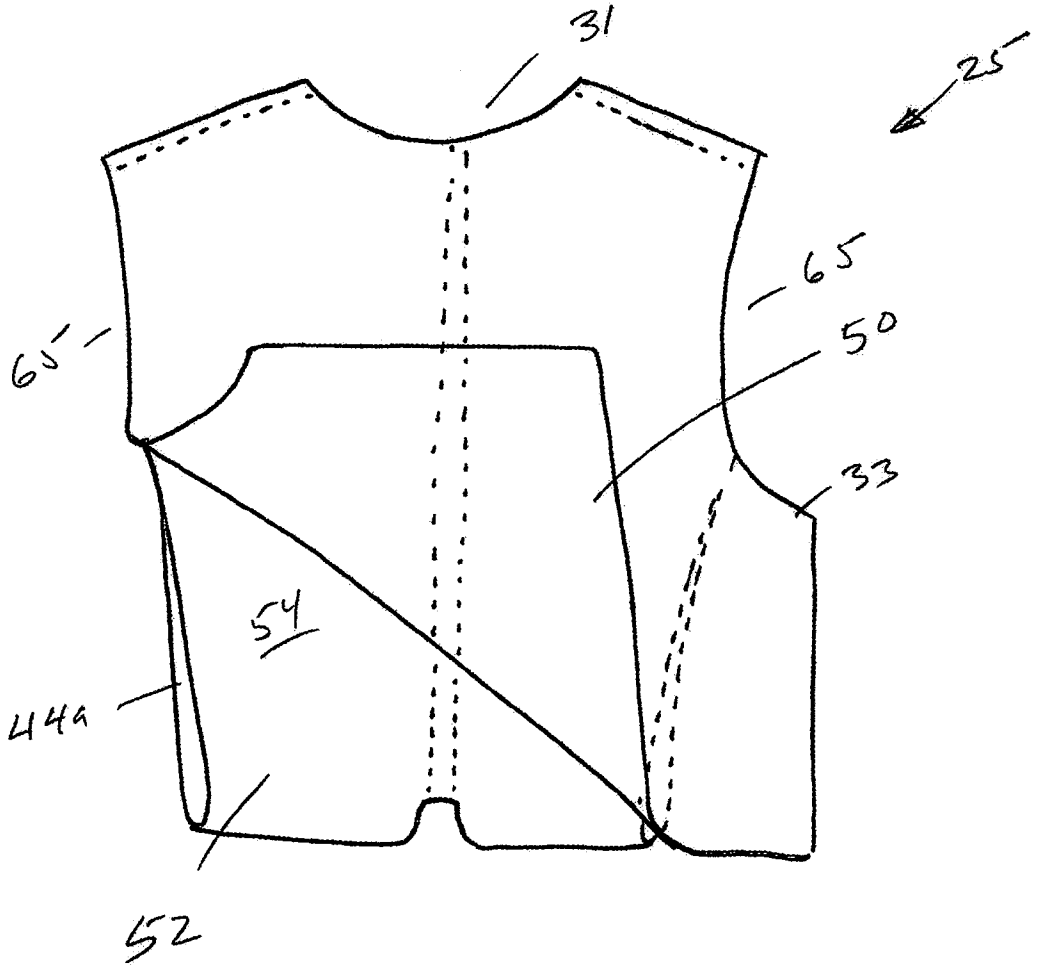
FIG. 8 is an outside view of the back portion of the cover, indicating preferred construction wherein the outer fabric layer hangs freely from inner layers, demonstrated by the fabric layer being folded up.

FIG. 8 is a schematic drawing indicating the sling 52, which is covered outside by the outer fabric layer 50. This can be considered the back side 26*a* of the mantle, in that the front side preferably has the horizontal securement line 66 (e.g. stitch line) forming the document pockets. FIG. 8 demonstrates the free hanging of the outer fabric layer, detached from the inner layer and from the sling up to a region at least to the arm holes 65 of the mantle. Preferably both the inner liner 44 and the intermediate liner 54 are detached from the outer fabric layer throughout the height of the mantle at front, unless, as preferred at front, the mantle includes a document pocket as shown in FIG. 6A.

Figure 9:
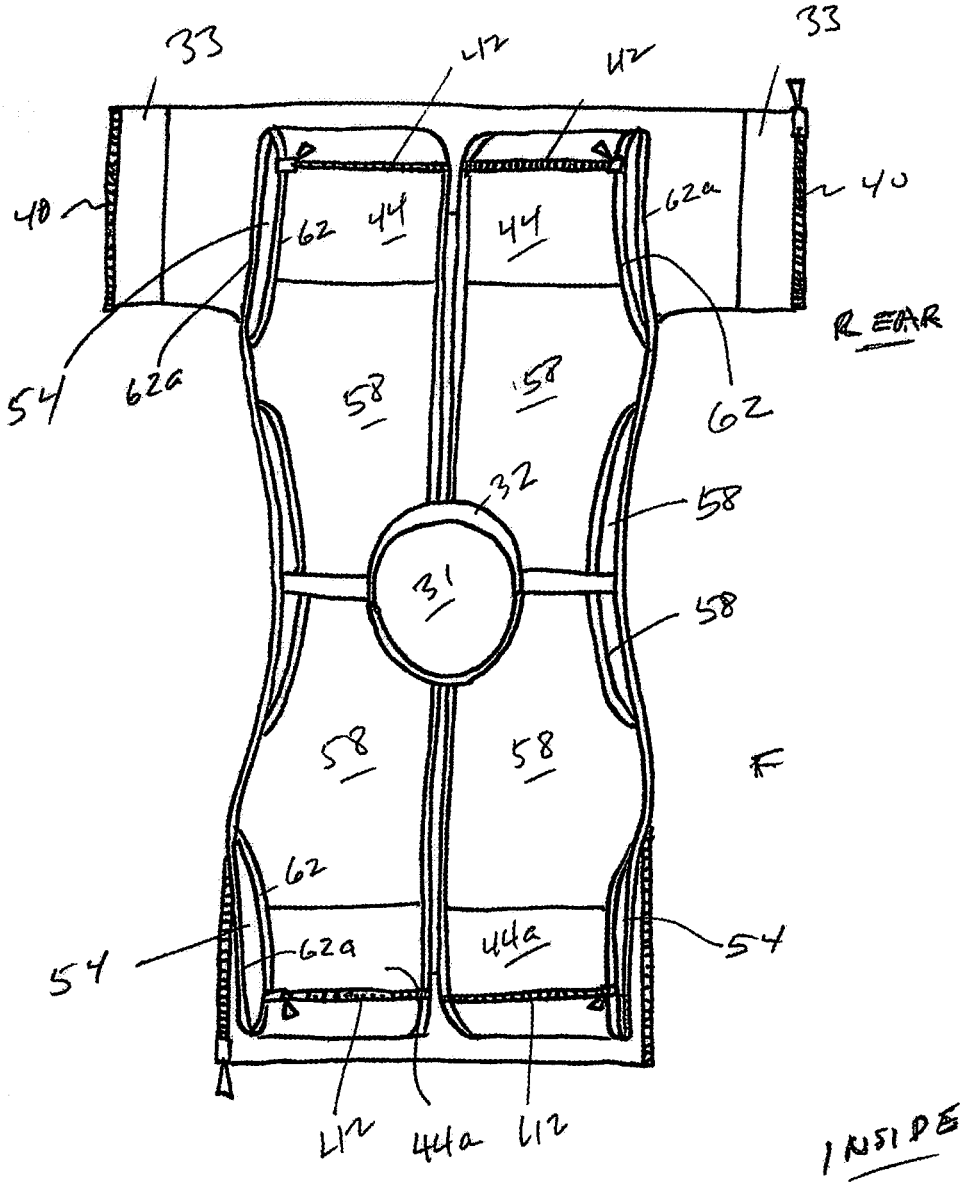
FIG. 9 is a view similar to FIG. 7 but with the inner liner panels zipped.

FIG. 9, similar to FIG. 7 but inverted, shows the inner side of the mantle with zippers 42 zipped together, and also revealing the thermal pack pouch 58 openings at left and right, front and back. The layers 58 forming the pouches are shown attached to the inner layers 44, 44*a*.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A wearable cover for a ballistic vest carrier, the carrier including a front armor panel and a rear armor panel, attachable waist straps to attach the front armor panel to the rear armor panel, and attachable shoulder straps for attaching the front panel of the carrier to the rear panel of the carrier at shoulders of the wearer, prior to donning the cover, the cover comprising:

a mantle configured to extend from front to rear over shoulders of the wearer, at approximately waist level at front and rear and having a head/neck opening, front and back sides and left and right sides, with recesses in the left and right sides to define arm openings when the mantle is worn, the mantle having an outer fabric layer at front and back, and an inner liner attached to the outer fabric layer at sides, at shoulder areas and at the head/neck opening of the mantle, and an additional liner positioned between the outer fabric layer and the inner liner, secured to the inner liner so as to produce a sling with the inner liner to receive and support portions of the ballistic vest carrier at front and back, the outer fabric layer being detached from the inner liner at bottom edges of the front and back of the mantle, the sling being openable and closable at or near a bottom of the sling for insertion of the ballistic vest carrier portions;

wherein the inner liner at both the front and back of the mantle is split along a vertical center line and along the bottom edge, and includes releasable attachment means along the bottom edge, such that for insertion of a portion of the ballistic vest carrier, the two sides of the liner can be pulled upwardly and outwardly for easy access to load the ballistic vest carrier portion onto the sling, and wherein the split extends up between the arm openings to the neck opening.

2. The cover of claim 1, further including a wicking cushioned collar at a back side of the head/neck opening of the mantle.

3. The cover of claim 1, wherein the mantle further includes pockets at least at front of the mantle, formed between the outer fabric layer and the sling, for receiving thermal packs for comfort of the wearer.

4. The cover of claim 3, wherein the mantle includes pockets at both front and back of the mantle.

5. The cover of claim 4, wherein each pocket is formed by a further layer attached to the inner liner, and each pocket being open or openable at left or right side for convenient insertion/removal of thermal packs.

* * * * *